US011633641B2

(12) United States Patent
Kutschat

(10) Patent No.: US 11,633,641 B2
(45) Date of Patent: Apr. 25, 2023

(54) STRETCH BAND OR CORD EXERCISE APPARATUS AND METHODS OF USING THE SAME

(71) Applicant: Stephen Kutschat, Lake Zurich, IL (US)

(72) Inventor: Stephen Kutschat, Lake Zurich, IL (US)

( * ) Notice: Subject to any disclaimer, the term of this patent is extended or adjusted under 35 U.S.C. 154(b) by 0 days.

(21) Appl. No.: 17/719,596

(22) Filed: Apr. 13, 2022

(65) Prior Publication Data

US 2022/0323814 A1 Oct. 13, 2022

Related U.S. Application Data

(60) Provisional application No. 63/174,218, filed on Apr. 13, 2021.

(51) Int. Cl.
*A63B 21/04* (2006.01)
*A63B 21/00* (2006.01)
*A63B 21/055* (2006.01)

(52) U.S. Cl.
CPC ..... *A63B 21/0442* (2013.01); *A63B 21/0552* (2013.01); *A63B 21/4033* (2015.10)

(58) Field of Classification Search
CPC ..... A63B 21/00058; A63B 21/00061; A63B 21/00065; A63B 21/00076; A63B 21/00178; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/08; A63B 21/16; A63B 21/4023; A63B 21/4025; A63B 21/4027; A63B 21/4033; A63B 21/4034; A63B 21/4035; A63B 21/4037; A63B 21/4043
See application file for complete search history.

(56) References Cited

U.S. PATENT DOCUMENTS 1,019,861 A * 3/1912 Titus ..... A63B 23/12 482/123
1,623,670 A * 4/1927 Frankenfeld ..... A63B 21/4035 482/123
1,623,671 A * 4/1927 Frankenfeld ..... A63B 21/0552 482/123
6,220,994 B1 * 4/2001 Rich ..... A63B 23/03508 482/130

(Continued)

*Primary Examiner* — Gary D Urbiel Goldner
(74) *Attorney, Agent, or Firm* — Scherrer Patent & Trademark Law, P.C.; Stephen T. Scherrer; Monique A. Morneault

(57) ABSTRACT

A stretch band or cord exercise apparatus comprises a flat planar base having a plurality of connection elements around a portion of a perimeter thereof. Stretch bands, bungee cords, or other similar stretch cord or band, may be attached, hooked, tied to, or otherwise disposed on one or more of the plurality of connection elements and utilized for one or more exercises by a user standing on or adjacent to the apparatus. The apparatus may be disposed on a floor, or may be attached to a different horizontal surface, such as a raised platform, a table, or even a ceiling, or may be attached to a vertical surface. Methods of using the same are further provided.

20 Claims, 4 Drawing Sheets

(56) References Cited

U.S. PATENT DOCUMENTS

| | | | | |
|---|---|---|---|---|
| 6,299,569 | B1 * | 10/2001 | Rich | A63B 21/4001 482/121 |
| 6,500,104 | B1 * | 12/2002 | Rich | A63B 21/1609 482/904 |
| D482,748 | S * | 11/2003 | Flynt | D21/692 |
| D599,419 | S * | 9/2009 | Chiuchiarelli | D21/662 |
| D700,792 | S * | 3/2014 | Melton | A63B 21/0557 D6/675 |
| 9,061,172 | B1 * | 6/2015 | Carrier | A63B 21/0557 |
| 9,259,606 | B2 * | 2/2016 | Wolan | A63B 21/0442 |
| 10,220,236 | B2 * | 3/2019 | Oltorik, Jr. | A63B 23/03525 |
| 10,286,244 | B2 * | 5/2019 | Reese | A63B 21/16 |
| 10,434,365 | B2 * | 10/2019 | Mack | A63B 21/0552 |
| 10,610,728 | B2 * | 4/2020 | Fano | A63B 21/0557 |
| 10,940,354 | B2 * | 3/2021 | Oltorik Jr. | A63B 21/4043 |
| D930,093 | S * | 9/2021 | Lyu | A63B 23/12 D21/686 |
| 2007/0087920 | A1 * | 4/2007 | Dachraoui | A63B 21/0552 482/121 |
| 2011/0251033 | A1 * | 10/2011 | Blancher | A63B 22/16 482/123 |
| 2014/0066262 | A1 * | 3/2014 | Kennedy | A63B 71/0036 482/52 |
| 2014/0155232 | A1 * | 6/2014 | Wolan | A63B 21/0442 482/123 |
| 2016/0144217 | A1 * | 5/2016 | Oltorik, Jr. | A63B 21/4043 482/130 |
| 2020/0023229 | A1 * | 1/2020 | Oltorik | A63B 21/0557 |

* cited by examiner

STRETCH BAND OR CORD EXERCISE APPARATUS AND METHODS OF USING THE SAME

CROSS-REFERENCE TO RELATED APPLICATIONS

The present invention claims priority to U.S. Provisional Pat. App. No. 63/174,218, titled "Stretch Band or Cord Exercise Apparatus and Methods of Using the Same," filed Apr. 13, 2021, which is incorporated herein by reference in its entirety.

TECHNICAL FIELD

The present invention relates to a stretch band or cord exercise apparatus. Specifically, the present invention comprises a flat planar base having a plurality of connection elements around a portion of a perimeter thereof or in any other location. Stretch bands, bungee cords, or other similar stretch cord or band, may be attached, hooked, tied to, or otherwise disposed on one or more of the plurality of connection elements and utilized for one or more exercises by a user standing on or adjacent to the apparatus. The apparatus may be disposed on a floor, or may be attached to a different horizontal surface, such as a raised platform, a table, or even a ceiling, or may be attached to a vertical surface. Methods of using the same are further provided.

BACKGROUND

Exercise equipment, of course, is known for allowing users to isolate and exercise certain muscles or muscle groups. Of course, the exercise industry is large, with many different types of exercise equipment that may be used for such a purpose. However, most exercise apparatuses are complicated, difficult to utilize, large, bulky and expensive. A need exists for an improved exercise apparatus. Specifically, a need exists for an exercise apparatus that is simple to use, relatively small in stature, and relatively inexpensive. For example, a need exists for an improved exercise apparatus that may be used when desired, and easily stored, such as under a bed, in a closet, or the like when not in use.

Exercise that involves the use of stretch bands or cords is often used by individuals because this type of resistance exercise is easy on joints and muscles. For that reason, stretch bands and cords are often utilized for rehabilitation, and is often recommended exercises for elderly individuals. However, it is often difficult to use stretch bands or cords for a large number of different exercises. Often, stretch bands and cords are simply tied to items, such as legs of tables or chairs, to provide the anchoring point for use in exercise. Thus, exercise can be extremely limited. A need, therefore, exists for an exercise apparatus that provides a plurality of tie-down or attachment points for stretch bands or cords. Specifically, a need exists for an exercise apparatus that provides a plurality of different exercises when used together with stretch bands or cords. More specifically, a need exists for an exercise apparatus that offers a plurality of combinations of attachment points to allow for different exercises.

Stretch bands or cords also oftentimes must be swapped if a user wishes to increase or decrease the tension therein. Specifically, stretch bands or cords are often color-coded to denote an equivalency in weight depending on the amount a band is stretched. Thus, to increase the effective weight and, therefore, work using a stretch band, the band can be stretched to larger degrees. However, this may be difficult if a stretch band is tied around a table or chair leg. A need, therefore, exists for an exercise apparatus that easily allows a user to set a stretch band or cord for a desired amount of stretch. Specifically, a need exists for an exercise apparatus that allows a user to tie or otherwise lock a stretch band or cord to provide a desired extent of stretch, thereby precisely providing a desired equivalent weight when used in an exercise routine.

SUMMARY OF THE INVENTION

The present invention relates to a stretch band or cord exercise apparatus. Specifically, the present invention comprises a flat planar base having a plurality of connection elements around a portion of a perimeter thereof or in any other location. Stretch bands, bungee cords, or other similar stretch cord or band, may be attached, hooked, tied to, or otherwise disposed on one or more of the plurality of connection elements and utilized for one or more exercises by a user standing on or adjacent to the apparatus. The apparatus may be disposed on a floor, or may be attached to a different horizontal surface, such as a raised platform, a table, or even a ceiling, or may be attached to a vertical surface. Methods of using the same are further provided.

To this end, in an embodiment of the present invention, an exercise apparatus is provided. The exercise apparatus comprises: a planar base; and a plurality of stretch band or cord connection elements, each connection element configured to connect a stretch band or cord thereto.

In an embodiment, the exercise apparatus further comprises: a stretch band or cord attached to at least one of the connection elements.

In an embodiment, the exercise apparatus further comprises: a stretch band or cord attached to a first connection element and a second connection element.

In an embodiment, the stretch band or cord is attached to the first connection element at a terminal end of the stretch band or cord.

In an embodiment, the stretch band or cord is attached to the second connection element at a location on the stretch band or cord between terminal ends of the stretch band or cord.

In an embodiment, the stretch band or cord is attached to the second connection element via being wrapped around the second connection element.

In an embodiment, at least one of the connection elements is selected from the group consisting of a peg, a hook, a loop, a ring, an aperture, and a carabiner.

In an embodiment, the exercise apparatus further comprises: a first stretch band or cord attached to a first of the plurality of connection elements; and a second stretch band or cord attached to a second of the plurality of connection elements.

In an embodiment, the first stretch band or cord is attached to the first connection element at a terminal end of the first stretch band or cord and further wherein the first stretch band or cord is attached to a third connection element between terminal ends of the first stretch band or cord.

In an embodiment, the second stretch band or cord is attached to the second connection element at a terminal end of the second stretch band or cord and further wherein the second stretch band is attached to a fourth connection element between terminal ends of the second stretch band or cord.

In an embodiment, the connection elements are disposed around a periphery of the planar base.

In an embodiment, the exercise apparatus further comprises: a standing area configured for a user to stand thereon when the planar base is placed on a floor.

In an embodiment, the exercise apparatus further comprises: a hanging element on a back side of the planar base configured for hanging the planar base on a wall.

In an embodiment, the exercise apparatus further comprises: a stretch band or cord attached to at least one of the connection elements; and a handle attached to the stretch band or cord configured to allow a user to perform an exercise with the stretch band or cord while attached to the connection element.

In an alternate embodiment of the present invention, a method of using an exercise apparatus is provided. The method comprises the steps of: providing an exercise apparatus comprising a planar base and a plurality of stretch band or cord connection elements, each connection element configured to connect a stretch band or cord thereto; attaching a first stretch band or cord to a first connection element of the plurality of connection elements; and performing an exercise using the first stretch band or cord attached to the first connection element.

In an embodiment, the method further comprises the steps of: attaching the first stretch band or cord to a second connection element of the plurality of connection elements.

In an embodiment, the first stretch band or cord is attached to the first connection element at a terminal end of the first stretch band or cord and the first stretch band or cord is further attached to the second connection element at a location between terminal ends of the first stretch band or cord.

In an embodiment, the method further comprises the steps of: attaching a second stretch band or cord to a second connection element of the plurality of connection elements; and performing an exercise using both the first and the second stretch bands or cords.

In an embodiment, the first stretch band or cord is attached to the first connection element at a terminal end of the first stretch band or cord and the first stretch band or cord is further attached to a third connection element at a location between terminal ends of the first stretch band or cord.

In an embodiment, a second stretch band or cord is attached to the second connection element at a terminal end of the second stretch band or cord and the second stretch band or cord is further attached to a fourth connection element at a location between terminal ends of the second stretch band or cord.

It is, therefore, an advantage and objective of the present invention to provide an improved exercise apparatus.

Specifically, it is an advantage and objective of the present invention to provide an exercise apparatus that is simple to use, relatively small in stature, and relatively inexpensive.

For example, it is an advantage and objective of the present invention to provide an improved exercise apparatus that may be used when desired, and easily stored, such as under a bed, closet or the like when not in use.

In addition, it is an advantage and objective of the present invention to provide an exercise apparatus that provides a plurality of tie-down or attachment points for stretch bands or cords.

Specifically, it is an advantage and objective of the present invention to provide a plurality of different exercises when used together with stretch bands or cords.

More specifically, it is an advantage and objective of the present invention to provide an exercise apparatus that offers a plurality of combinations of attachment points to allow for different exercises.

Further, it is an advantage and objective of the present invention to provide an exercise apparatus that easily allows a user to set a stretch band or cord for a desired amount of stretch.

Specifically, it is an advantage and objective of the present invention to provide an exercise apparatus that allows a user to tie or otherwise lock a stretch band or cord to provide a desired extent of stretch, thereby precisely providing a desired equivalent weight when used in an exercise routine.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a stretch band or cord exercise apparatus. Specifically, the present invention comprises a flat planar base having a plurality of connection elements around a portion of a perimeter thereof or in any other location. Stretch bands, bungee cords, or other similar stretch cord or band, may be attached, hooked, tied to, or otherwise disposed on one or more of the plurality of connection elements and utilized for one or more exercises by a user standing on or adjacent to the apparatus. The apparatus may be disposed on a floor, or may be attached to a different horizontal surface, such as a raised platform, a table, or even a ceiling, or may be attached to a vertical surface. Methods of using the same are further provided.

Figure 1:
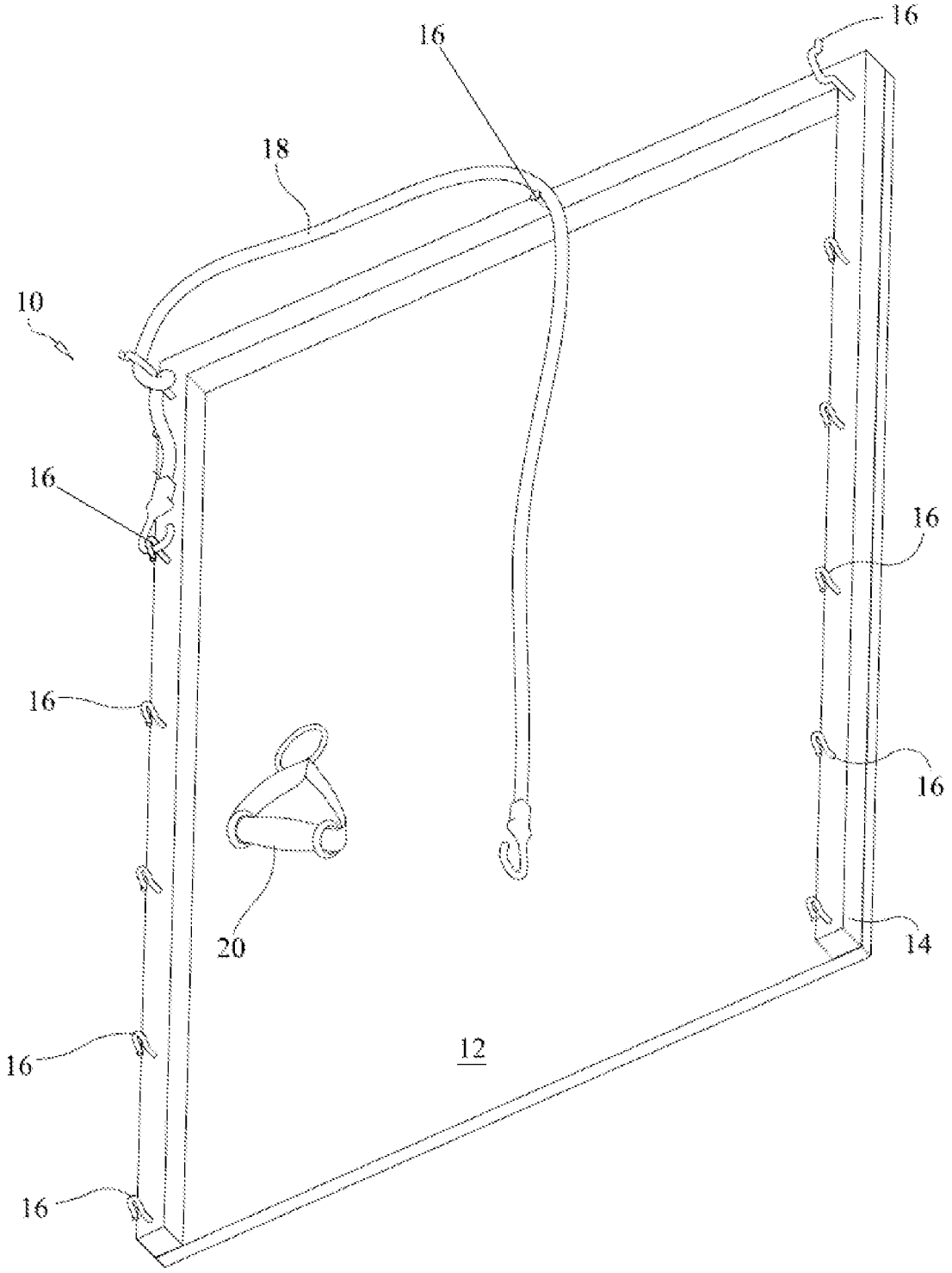
FIG. 1 illustrates a top view of an exercise apparatus in an embodiment of the present invention.

Referring now to the figures, FIG. 1 illustrates an exercise apparatus 10 in an embodiment of the present invention. The exercise apparatus 10 generally comprises a flat panel or planar base 12 and a peripheral partial frame 14 extending around at least a portion of the base 12. The frame 14 may extend from the periphery of the base 12 so as to provide a plurality of connection elements 16, such as, for example, pegs, hooks, loops, rings, apertures, and/or carabiners, at various locations on the frame 14. Although the frame 14 is shown as extending around three sides of the base 12, it should be noted that the frame 14 may extend around less than three sides or all four sides, and the invention should not be limited as shown and described herein. Likewise, although the base 12 is shown as a rectangle, it may be any shape and should also not be limited.

Preferably, the frame 14 extends around only three of the sides of the base 12, allowing a user to easily walk onto and stand on the base 12 without presenting a tripping hazard for the user. Moreover, any number of connection elements 16 may extend from the frame 14, or from any other location of the base 12.

Figure 2:
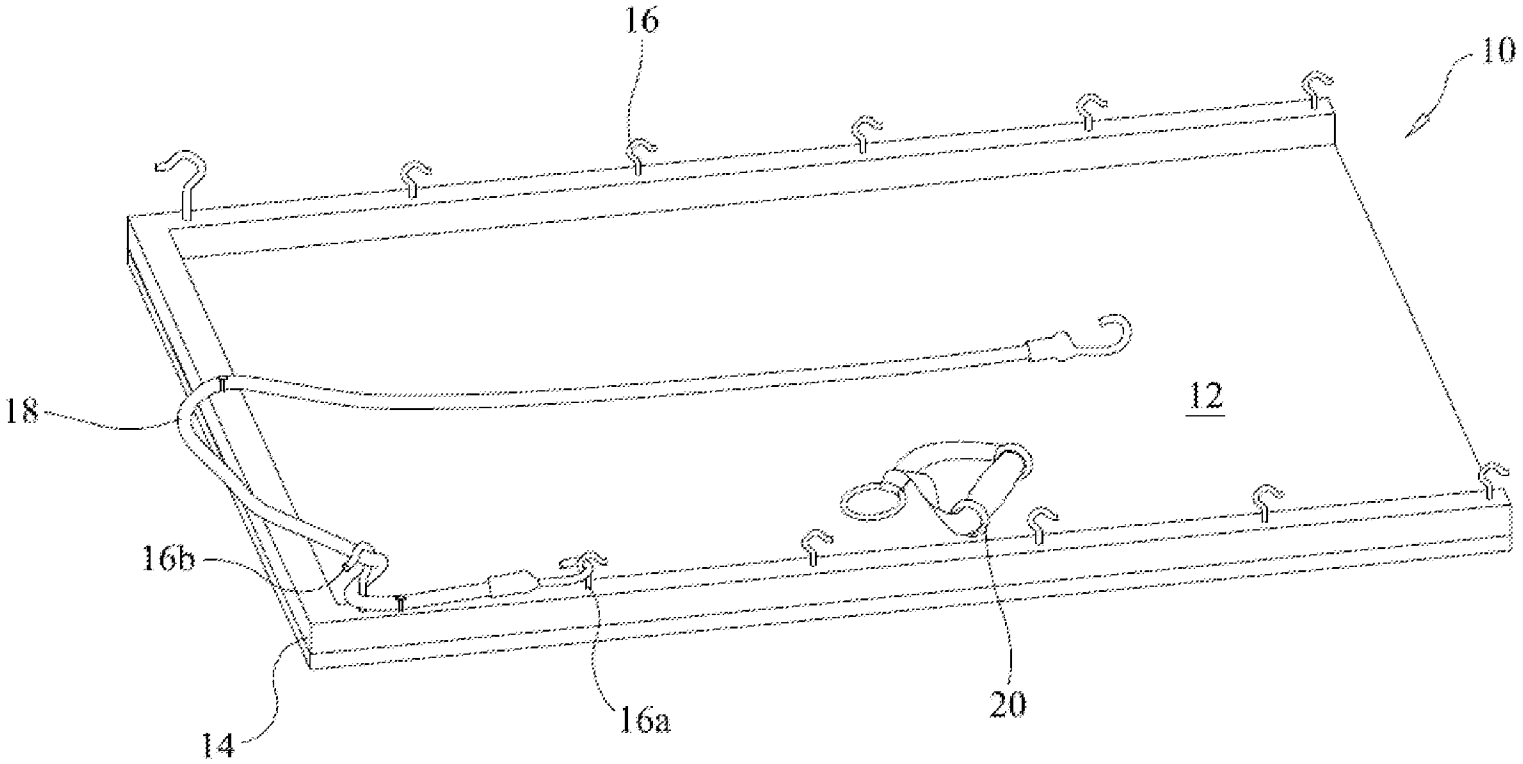
FIG. 2 illustrates a side elevated perspective view of an exercise apparatus in an embodiment of the present invention.
Figure 3:
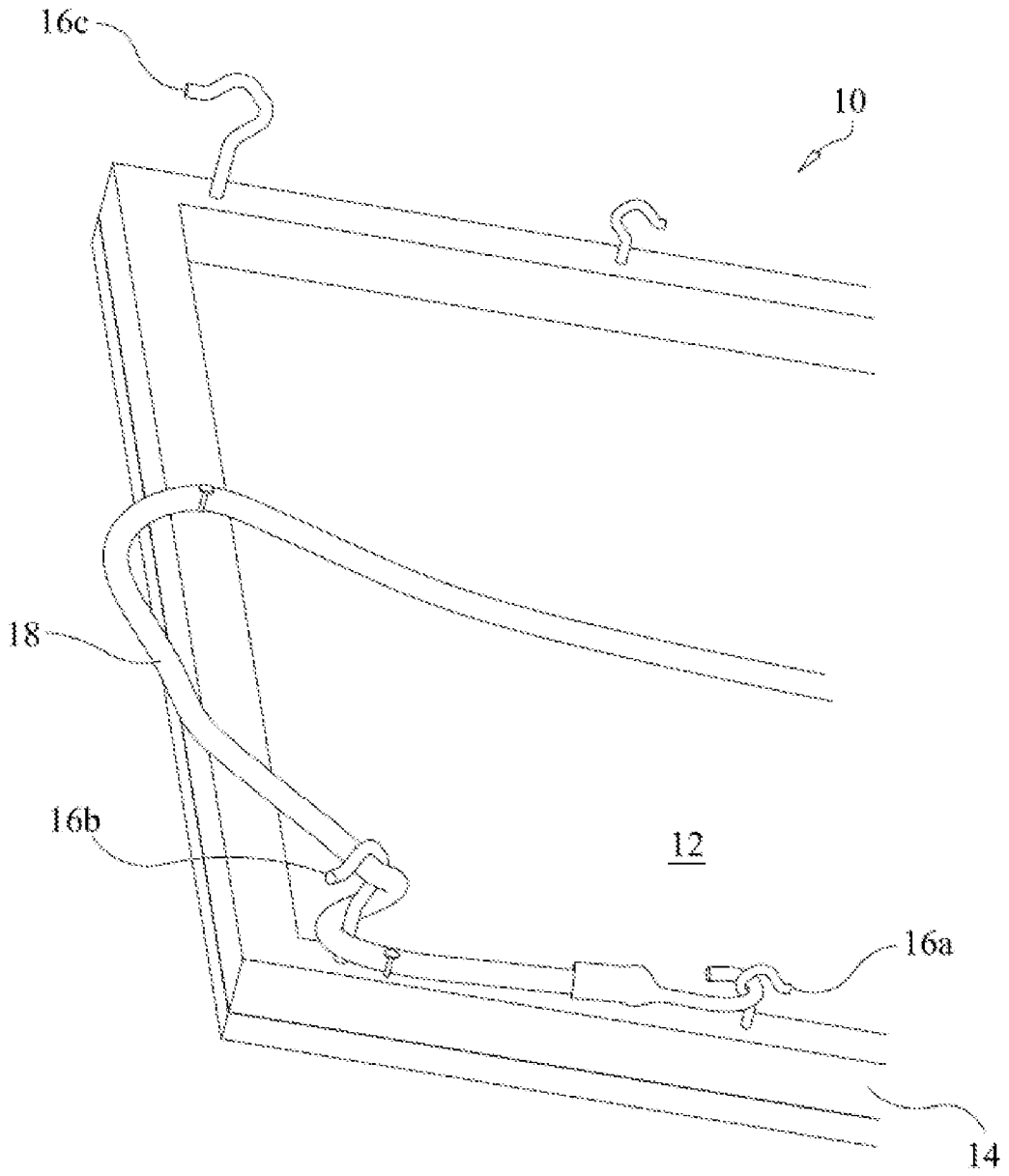
FIG. 3 illustrates a close-up perspective view of an exercise apparatus in an embodiment of the present invention.

As illustrated in FIG. 2, the connection elements 16 may allow a stretch cord 18 or stretch band to be connected thereto. As shown in FIGS. 2 and 3, stretch cord 18 is hooked to connection element 16*a*, in the form of a peg or hood, and wrapped around connection element 16*b*. This allows the stretch cord to be shortened as desired when in use, thereby providing more tension and, effectively, more effective weight to a user during a workout. The stretch cord 18 is further wrapped around connection element 16*c*, which may re-direct the stretch cord therearound to make it easier to use by a user thereof, since connection element 16*c* is disposed in a center of the frame 14.

Figure 4:
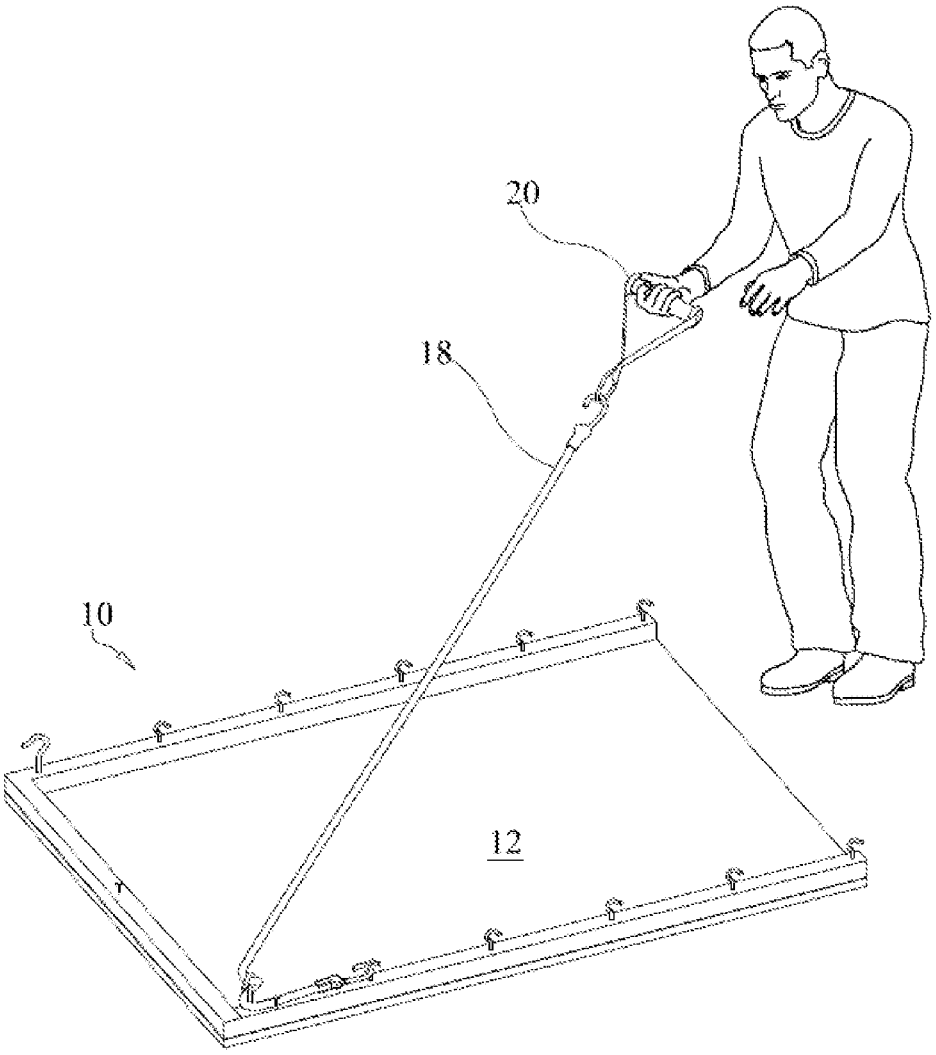
FIG. 4 illustrates an elevated perspective view of an exercise apparatus and an exerciser using the exercise apparatus with a stretch cord in an embodiment of the present invention.

FIG. 4 illustrates a user utilizing the exercise apparatus 10 with a stretch cord 18 having a handle 20 attached to one side thereof, and the other side wrapped around connection element 16*b* and hooked to connection element 16*a*. Because the stretch cord 18 is wrapped around connection element 16*b*, it is effectively shortened, allowing the stretch cord 18 to be utilized at a desired height by the user (as illustrated as the user performs arm curls with the stretch cord 18). Moreover, wrapping the stretch cord 18 around connection element 16*b* also shortens the stretch cord 18 providing additional tension to the stretch cord 18 and increasing its effective "weight" when in use during an exercise routine.

Using the plurality of connection elements 16, the stretch cords or stretch bands can be routed in any direction for use by an exerciser. For example, the stretch cord or stretch wrap may be positioned to allows the user to do arm exercises (an example of which is shown in FIG. 4), leg exercises, hand exercises, ankle exercises, shoulder exercises, and any number of other types of exercises.

Moreover, the exercise apparatus 10 may be placed on any surface, such as any horizontal surface, such as a floor, a table, or even on the ceiling facing down, or on a vertical surface, such as a wall, to provide different angles to which stretch cords or bands can be attached and utilized by a user thereof.

Because the exercise apparatus 10 is relatively short in height, it may be useful for storing in out-of-the-way locations, for example under furniture, such as under beds, within closets, or other like locations. Moreover, it is light weight, making it easy to move and utilize by an exerciser.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An exercise apparatus comprising:

a planar base configured to be placed substantially horizontally on a floor and having first and second longitudinal sides and first and second lateral sides;

a first frame wall extending along the first longitudinal side, a second frame wall extending along the first lateral side, and a third frame wall extending along the second longitudinal side;

a plurality of connection elements configured to be respectively connected to a plurality of stretch bands or cords, each of the plurality of connection elements attached to and extending vertically upwards from an uppermost surface of a respective at least one of the first frame wall, the second frame wall, and the third frame wall.

2. The exercise apparatus of claim 1 further comprising:

one of the plurality of stretch bands or cords attached to at at least one of the plurality of connection elements.

3. The exercise apparatus of claim 1 further comprising:

one of the plurality of stretch bands or cords attached to a a first connection element and a second connection element of the plurality of connection elements.

4. The exercise apparatus of claim 3 wherein the one of the plurality of stretch bands or cords is attached to the first connection element at a terminal end of the one of the plurality of stretch bands or cords.

5. The exercise apparatus of claim 3 wherein the one of the plurality of stretch bands or cords is attached to the second connection element at a location on the one of the plurality of stretch bands or cords between terminal ends of the one of the plurality of stretch bands or cords.

6. The exercise apparatus of claim 3 wherein the one of the plurality of stretch bands or cords is attached to the second connection element via being wrapped around the second connection element.

7. The exercise apparatus of claim 1 wherein at least one of the plurality of connection elements is selected from the group consisting of a peg, a hook, a loop, a ring, an aperture, and a carabiner.

8. The exercise apparatus of claim 1 further comprising:

a first of the plurality of stretch bands or cords attached to a first of the plurality of connection elements; and a second of the plurality of stretch bands or cords attached to a second of the plurality of connection elements.

9. The exercise apparatus of claim 8 wherein the first stretch band or cord is attached to the first connection element at a terminal end of the first stretch band or cord and further wherein the first stretch band or cord is attached to a third connection element of the plurality of connection elements between terminal ends of the first stretch band or cord.

10. The exercise apparatus of claim 9 wherein the second stretch band or cord is attached to the second connection element at a terminal end of the second stretch band or cord or cord and further wherein the second stretch band is attached to a fourth connection element of the plurality of connection elements between terminal ends of the second stretch band or cord.

11. The exercise apparatus of claim 1 wherein the plurality of connection elements are disposed around a periphery of the planar base.

12. The exercise apparatus of claim 1 further comprising:

a standing area configured for a user to stand thereon when the planar base is placed on the floor.

13. The exercise apparatus of claim 1 further comprising:

a hanging element on a back side of the planar base configured for hanging the planar base on a wall.

14. The exercise apparatus of claim 1 further comprising:

one of the plurality of stretch bands or cords attached to at least one of the plurality of connection elements; and a handle attached to the one of the plurality of stretch bands or cords and configured to allow a user to perform an exercise with the one of the plurality of stretch bands or cords while the one of the plurality of stretch bands or cords is attached to the at least one of the plurality of connection elements connection element.

15. A method of using an exercise apparatus, the method comprising the steps of:

providing an exercise apparatus comprising a planar base configured to be placed substantially horizontally on a floor and having first and second longitudinal sides and first and second lateral sides, a first frame wall extending along the first longitudinal side, a second frame wall extending along the first lateral side, and a third frame wall extending along the second longitudinal side, and a plurality of connection elements configured to be respectively connected to a plurality of stretch bands or cords, each of the plurality of connection elements attached to and extending vertically upwards from an uppermost surface of a respective at least one of the first frame wall, the second frame wall, and the third frame wall attaching a first of the plurality of stretch bands or cords to a first connection element of the plurality of connection elements; and performing an exercise using the first stretch band or cord attached to the first connection element.

16. The method of claim 15 further comprising the steps of:

attaching the first stretch band or cord to a second connection element of the plurality of connection elements.

17. The method of claim 16 wherein the first stretch band or cord is attached to the first connection element at a terminal end of the first stretch band or cord and the first stretch band or cord is further attached to the second connection element at a location between terminal ends of the first stretch band or cord.

18. The method of claim 15 further comprising the steps of:

attaching a second of the plurality of stretch bands or cords to a second connection element of the plurality of connection elements; and performing an exercise using both the first and the second stretch bands or cords.

19. The method of claim 18 wherein the first stretch band or cord is attached to the first connection element at a terminal end of the first stretch band or cord and the first stretch band or cord is further attached to a third connection element of the plurality of connection elements at a location between terminal ends of the first stretch band or cord.

20. The method of claim 19 wherein the second stretch band or cord is attached to the second connection element at a terminal end of the second stretch band or cord and the second stretch band or cord is further attached to a fourth connection element of the plurality of connection elements at a location between terminal ends of the second stretch band or cord.

* * * * *